United States Patent [19]

Breuer et al.

[11] 4,139,370

[45] Feb. 13, 1979

[54] METHOD OF REFINING FERRO-ALLOYS

[75] Inventors: Friedrich Breuer, Eschweiler; Karl Brotzmann, Sulzbach-Rosenberg; Günter Düderstadt, Hosel; Rudolf Fichte, Nuremberg; Fritz Stadler, Meererbusch, all of Fed. Rep. of Germany

[73] Assignee: Gesellschaft für Elektrometallurgie mbH, Düsseldorf, Fed. Rep. of Germany

[21] Appl. No.: 842,349

[22] Filed: Oct. 17, 1977

Related U.S. Application Data

[63] Continuation-in-part of Ser. No. 527,826, Nov. 27, 1974.

[30] Foreign Application Priority Data

Jan. 13, 1972 [DE] Fed. Rep. of Germany ..... 2201388

[51] Int. Cl.$^2$ ..... C21C 5/34

[52] U.S. Cl. ..... 75/60; 75/59

[58] Field of Search ..... 75/60, 59

[56] References Cited

U.S. PATENT DOCUMENTS

| | | | |
|---|---|---|---|
| 3,615,349 | 10/1971 | Bleloch | 75/11 |
| 3,708,599 | 1/1973 | Krause | 75/60 |
| 3,751,242 | 8/1973 | Knuppel | 75/60 |
| 3,773,496 | 11/1973 | Kruppel | 75/60 |
| 3,844,768 | 10/1974 | Leroy | 75/60 |
| 3,867,136 | 2/1975 | Eriksson | 75/60 |
| 3,909,245 | 9/1975 | Brotzmann | 75/60 |
| 4,022,612 | 5/1977 | Bleloch | 75/60 |

*Primary Examiner*—P. D. Rosenberg
*Attorney, Agent, or Firm*—Karl F. Ross

[57] ABSTRACT

A ferro-alloy, namely ferrochrome or ferromanganese, is refined by being heated to at least 100° C above its melting point to form a bath whereupon oxygen is blown into the melt, below the bath surface, within a protective gas envelope. The rate of oxygen blowing is so chosen that 1% of carbon is oxidized within a period not to exceed about ten minutes, preferably not more than five minutes.

8 Claims, No Drawings

METHOD OF REFINING FERRO-ALLOYS

Cross-Reference to Related Application

This is a continuation-in-part of our copending application Ser. No. 527,826 filed Nov. 27, 1974.

FIELD OF THE INVENTION

Our present invention relates to the refining of high-carbon ferro-alloys, specifically ferrochrome or ferromanganese, by melting the ferro-alloy to form a bath and blowing oxygen into the melt below the bath surface.

BACKGROUND OF THE INVENTION

Ferro-alloys, widely used in making alloy steels, are compositions consisting mainly of iron and noneferrous metal with the latter predominating. Aside from carbon, the compositions may also include such nonmetallic constituents as silicon, sulfur and phosphorus as well as various impurities.

The removal of carbon by oxidation is well known in the refining of pig iron. It has also been proposed to adapt this technique to the refining of a mixture of pig iron and ferrochrome for the production of low-carbon chromium-alloy steel; see U.S. Pat. No. 3,751,242. As described in that patent, a prerefined pig-rion melt is admixed with a minor proportion of ferrochrome in a converter whereupon a jet of oxygen is introduced through a nozzle within a sheath of protective gas.

A problem generally encountered in the refining of ferrochrome and ferromanganese, even when use is made of a protective jacket gas, is the formation of high-melting chromium and manganese oxides from which these nonferrous metals can be recovered only by relatively expensive chemical reduction. This is particularly true where the nonferrous metal, i.e. the chromium or the manganese, is present in a proportion of more than 50% by weight so as to form the predominant constituent of the ferro-alloy.

OBJECT OF THE INVENTION

The object of our present invention, therefore, is to provide a method of refining high-carbon ferrochrome or ferromanganese per se, i.e. without admixing it with a prerefined ferrous melt, in a manner minimizing the formation of chromium or manganese oxides in the slag.

SUMMARY OF THE INVENTION

We have found, in accordance with our present invention, that high-carbon ferro-alloy containing chromium of manganese as its predominant constituent can be refined by heating it to a temperature at least 100° C. above its melting point and then blowing oxygen into the melt, below the surface of the preheated bath, in an amount sufficient to oxidize one weight percent of carbon within the melt in a period which should be not less than about one minute nor greater than about ten minutes, preferably not in excess of five minutes.

Solid solutions of iron in chromium have melting points in a range of about 1400° to 1450° C.; the corresponding range for a solid solution of iron in manganese is about 1060° to 1220° C. In the case of ferrochrome we prefer to preheat the bath to a temperature between substantially 1650° and 1750° C.; in the case of ferromanganese the preferred temperature ranges between substantially 1450° and 1650° C.

With these parameters, and with the oxygen jet or jets blown in more or less vertically with a nozzle velocity of about 100 to 1000 meters per second at a level lying approximately 25 to 80 cm below the bath surface, surprisingly little chromium or manganese goes into the slag as an oxide. Even this small loss can be nearly eliminated by blowing in alkaline-earth oxides, especially powdered lime, together with the oxygen as is known per se.

In order to stabilize the bath temperature during the blowing step, solid metallic additives — such as ferro-alloys of substantially the same composition as the melt — may be introduced into the bath in measured quantities.

The stoichiometric quantity of oxygen required for the removal of 1% C. (by weight) from a metric ton of melt is about 15 cubic meters S.T.P. so that, theoretically, between 3 and 15 $m^3$ S.T.P. of oxygen per minute would have to be blown in for each ton in order to oxidize 1 weight percent of carbon within a period of 1 to 5 minutes. In the presence of a substantial proportion of silicon, however, part of the oxygen is consumed in oxidizing the silicon so that this theoretical amoung needs to be increased, e.g. by up to 20%, for achieving the desired rate of decarburization.

A possible explanation for the favorable results obtained with our process, i.e. for the rapid reduction in carbon content without significant loss of chromium or manganese, may be that the reaction takes place in localized combustion zones below the bath surface, specifically within a string of gas bubbles formed at a certain distance from the injection nozzle or nozzles which depends upon the jet veocity. In these gas bubbles, which may combine into chains or elongated voids, not only the temperatures but also the pressures are higher than elsewhere in the bath; thus, the atmospheric and hydrostatic pressures normally present are supplemented by the surface tensions at the interfaces between the gas and the melt. It is at these interfaces that the ferrous and nonferrous components of the melt are oxidized in what may be an extremely thin layer, e.g. of monomolecular thickness, the oxides being thus in a highly reactive state conductive to an endothermic oxidation of the available carbon. That reaction can be expressed by the formulas $$2(Cr_2O_3)/3 + 2C = 4Cr/3 + 2CO$$

in the case of ferrochrome and $$2(Mn_2O)/3 + 2C \Delta 4Mn/3 + 2CO$$

in the case of ferromanganese.

Representative examples for the refining of ferrochrome and ferromanganese in accordance with our invention will now be given.

EXAMPLE 1

Production of a ferrochrome containing 4% to 6% carbon.

In an electric-arc furnace 212 metric tons of ferrochrome containing, by weight, 59.7% Cr,
7.27% C,
1.05% Si,
0.03% S,
0.05% P,
balance Fe and usual impurities, was superheated to 1670° C. (as noted above, the melting point of such an alloy ranges from 1400° to 1450° C.) and loaded into a converter in consecutive batches of 5.5 tons each. The converter had a magnesite refractory lining and was provided with a jacketed nozzle, located about 20 cm above floor level and 50 cm below the bath surface, through which oxygen was blown in at an angle of less than 25° to the vertical; butane was blown in at the same time, through the jacket, as a protective medium. 200 cubic meters (S.T.P.) of oxygen was blown for 6 to 12 minutes per charge. At the beginning of each blow, 260 kg of fine lime was also blow in. The temperature of the liquid melt was maintained at its aforestated level by the continuous introduction of a total of about 400 kg of ferrochrome fines (from 0 to 10% based on the total charge). At the end of the blow another 250 kg (about 5% based on the total converter charge) of ferrochrome fines was added to the alloy melt which was then immediately poured into a lined basin.

A total of 198 tons of ferrochrome was obtained containing 62.3% Cr,
4.9% C,
<0.10% Si
0.015% S,
0.015% P,
balance Fe and usual impurities.

Disregarding the fines, the chromium yield was 97.5%.

EXAMPLE 2

Production of a ferrochrome containing 1% to 2% carbon.

65 metric tons of a freeochrome consisting of 59.7% Cr,
7.18% C,
1.49% Si,
0.05% S,
0.06% P,
balance Fe and usual impurities, was superheated, as described in Example 1, to 1700°-1750° C. and then subjected to oxygen blowing in consecutive batches of 5.5 tons each. For each batch, 520 cubic meters (S.T.P.) of oxygen was blow for 15 to 25 minutes. As in Example 1, finely powdered lime was also blow in and about 20% of ferrochrome fines was added to the melt.

A total of 57 tons of ferrochrome was obtained consisting of 62.1% Cr,
1.11% C,
<0.10% Si,
0.012% S,
0.025% P,
balance Fe and usual impurities;

the chromium yield, disregarding the fines, was 91.2%.

EXAMPLE 3

Production of a ferrochrome containing 0.5% carbon 33 metric tons of a ferrochrome consisting of 59.7% Cr,
7.18% C,
1.89% Si,
0.03% S,
0.06% P,
balance Fe and usual impurities, was superheated as described in Example 1 to between 1700° and 1750° C. and then blown with oxygen in separate batches of 5.5 tons each. For each batch, 580 cubic meters (S.T.P.) of oxygen was blown in for 20 to 30 minutes. Again as in Example 1, 350 kg of finely powdered lime was also blown in and about 20% of ferrochrome fines was introduced into the melt.

A total of 28.5 tons of ferrochrome was obtained consisting of 62.5% Cr,
0.48% C,
<0.10% Si,
0.01% S,
0.025% P,
balance Fe and usual impurities.

The chromium yield, disregarding the fines, was 90.4%.

EXAMPLE 4

Production of a ferromanganese containing 1 to 2% carbon.

35 metric tons of a ferromanganese consisting of 75.7% Mn,
6.7% C,
0.85% Si,
0.03% S,
0.20% P,
balance Fe and usual impurities, was superheated, as described in Example 1, to between 1470° and 1500° C. (as stated before, the melting point of such an alloy ranges from 1060° to 1220° C.) and blown with oxygen in 5.5-ton batches. In each batch, about 500 cubic meters (S.T.P.) of oxygen was blow in for 15 to 20 minutes. As in Example 1, 150 kg of finely powdered lime was also blown in; there was further added 500 kg of ferromanganese fines during the blow and another 259 kg of ferromanganese fines after the blow to keep the temperature stable. A total of 30 tons of ferromanganese was obtained consisting of 74.7% Mn,
1.3% C,
1.10% Si,
0.01% S,
0.10% P,
balance Fe and usual impurities;

the manganese yield, disregarding the fines, was 83.9%.

Our invention is applicable to any ferrochrome or ferromanganese in which the nonferrous metal is present in an amount, by weight, of about 50% to 80% in the case of chromium and about 50% to 90% in the case of manganese. The initial proportion of silicon, though preferably not more than about 2%, may go as high as 6% if the oxygen rate is correspondingly increased or a reduction in the decarburization rate (to about 0.1% C. per minute) is accepted.

We claim:

1. A method of refining a high-carbon ferro-alloy whose predominant constituent is a nonferrous metal selected from the group which consists of chromium and manganese, comprising the steps of:

melting the ferro-alloy to form a bath;

heating said bath to a temperature at least 100° C. above the melting point of said ferro-alloy;

blowing oxygen enveloped by a protective gas into the melt below the surface of the heated bath, in an amount sufficient to oxidize one weight percent of carbon in the melt within a period not less than about one minute nor greater than about then minutes, at a rate ranging between substantially 3 and 15 cubic meters S.T.P. per minute multiplied by the number of metric tones of ferro-alloy in the melt, with oxidation of substantially 0.2% to 1% of carbon per minute.

2. A method as defined in claim 1 wherein the oxygen is blow at a rate ranging between substantially 3 and 15 cubic meters S.T.P. per minute multiplied by the number of metric tons of ferroalloy in the melt, with oxidation of substantially 0.2% to 1% of carbon per minute.

3. A method as defined in claim 1 wherein said nonferrous metal is chromium, said bath being heated to a temperature between substantially 1650° and 1750° C.

4. A method as defined in claim 3 wherein said ferroalloy consists essentially, by weight, of about 60% Cr, about 7% C., up to 2% Si, balance iron and usual impurities.

5. A method as defined in claim 1 wherein said nonferrous metal is manganese, said bath being heated to a temperature between substantially 1450° and 1650° C.

6. A method as defined in claim 5 wherein said ferroalloy consists essentially, by weight, of about 75% Mn, about 7% C., up to 2% Si, balance iron and usual impurities.

7. A method as defined in claim 1 wherein the temperature of said bath is maintained substantially constant during the blowing step by introducing solid metallic additives into the bath.

8. A method as defined in claim 1 wherein the oxygen is blow into the bath in a generally vertical upward direction with a nozzle velocity ranging between substantially 100 and 1000 meters per second at a level lying substantially between 25 and 80 cm below the bath surface.

* * * * *